United States Patent [19]

Achelpohl et al.

[11] 4,266,654

[45] May 12, 1981

[54] METHOD AND APPARATUS FOR SEPARATING GROUPS OF WORKPIECES BEING CONVEYED IN SUPERPOSED OVERLAPPING FORMATION

[75] Inventors: Fritz Achelpohl; Richard Feldkäper; Friedrich Blom, all of Lengerich, Fed. Rep. of Germany

[73] Assignee: Windmoller & Holscher, Lengerich, Fed. Rep. of Germany

[21] Appl. No.: 53,333

[22] Filed: Jun. 29, 1979

[30] Foreign Application Priority Data

Jul. 28, 1978 [DE] Fed. Rep. of Germany ..... 2832660

[51] Int. Cl.[3] ..... B65G 47/26

[52] U.S. Cl. ..... 198/425; 198/423; 198/428; 198/438; 271/284; 271/300; 271/302; 414/53

[58] Field of Search ..... 271/300, 302, 197, 293, 271/294, 284; 198/421, 425, 428, 431, 438, 439, 436, 689, 423; 414/51, 53, 73, 75; 93/93 K

[56] References Cited

U.S. PATENT DOCUMENTS

| | | | |
|---|---|---|---|
| 2,941,653 | 6/1960 | Kriemelmeyer | 198/689 X |
| 4,015,840 | 4/1977 | Schroder | 271/302 |

FOREIGN PATENT DOCUMENTS

| | | | |
|---|---|---|---|
| 2063875 | 6/1972 | Fed. Rep. of Germany | 271/284 |

*Primary Examiner*—Robert B. Reeves
*Assistant Examiner*—Douglas D. Watts
*Attorney, Agent, or Firm*—Fleit & Jacobson

[57] ABSTRACT

Overlapping sheet articles on a first suction conveyor are intermittently diverted in groups by a lowerable second suction conveyor having a direction-changing roller which can be intermittently applied to the first conveyor and moved along therewith at the same speed and then returned.

16 Claims, 7 Drawing Figures

Figure 1:
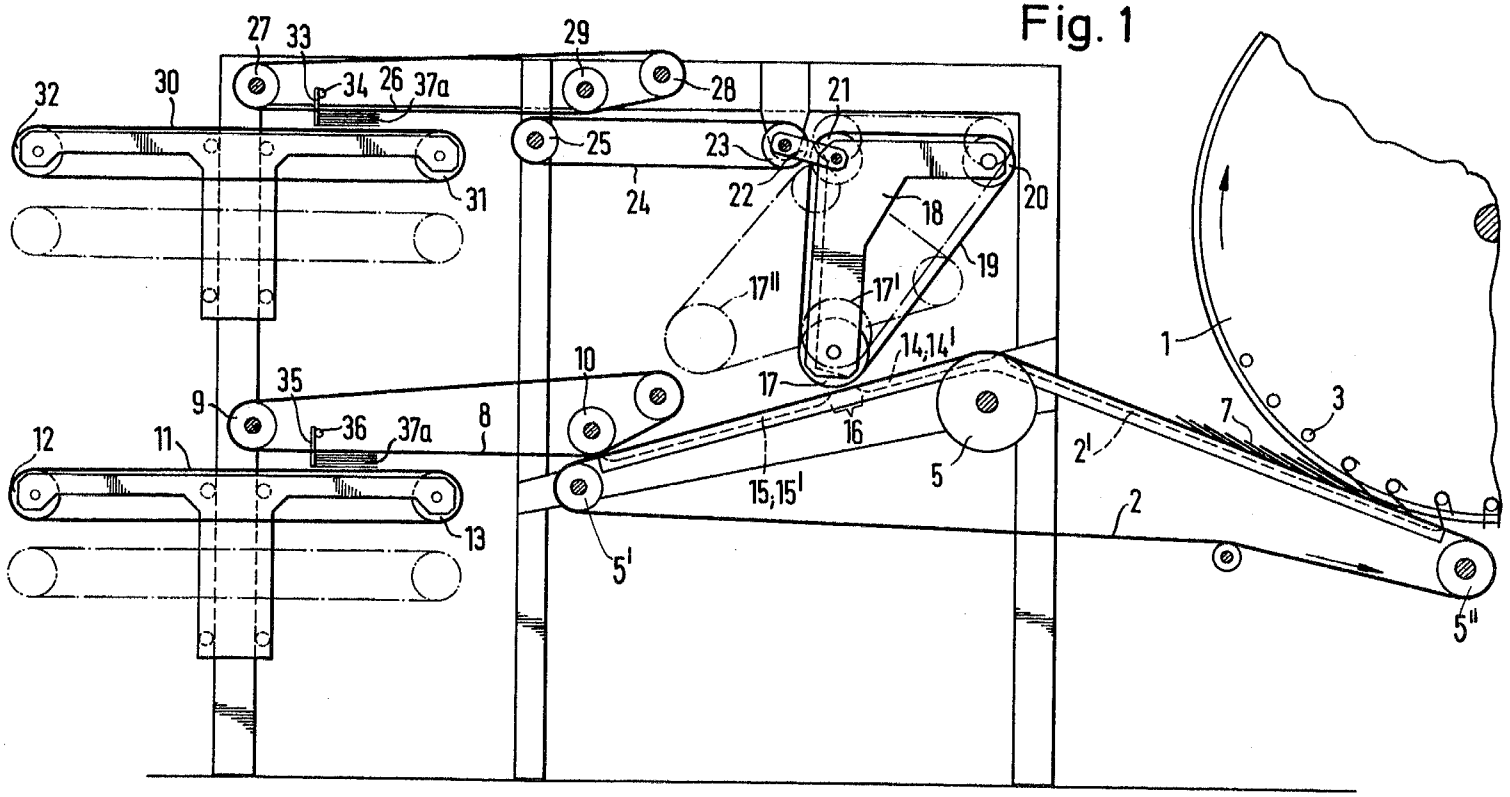

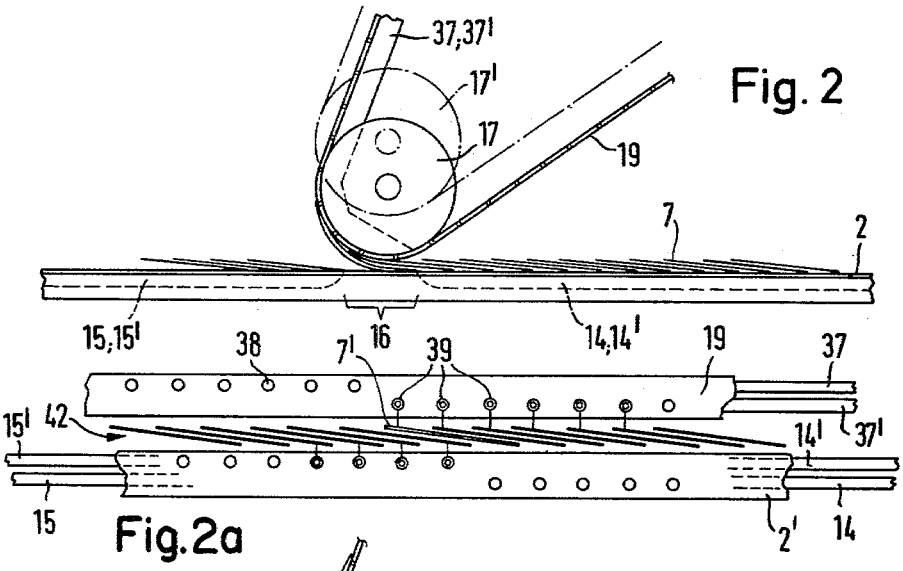
Fig. 2
Fig.2a
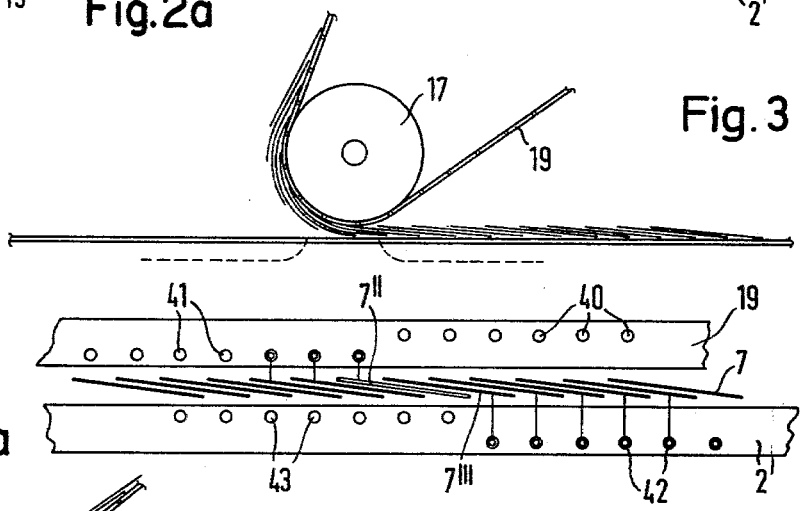
Fig. 3
Fig. 3a
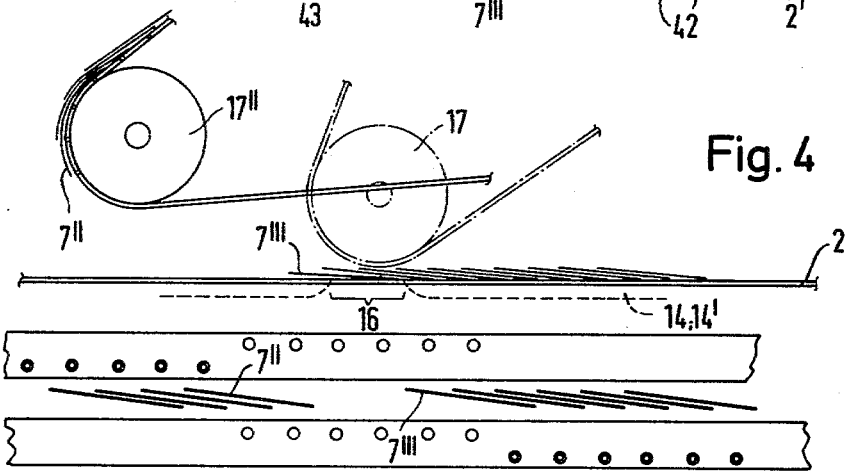
Fig. 4
Fig.4a

METHOD AND APPARATUS FOR SEPARATING GROUPS OF WORKPIECES BEING CONVEYED IN SUPERPOSED OVERLAPPING FORMATION

The invention relates to a method of separating groups of workpieces being conveyed in superposed overlapping formation by a first belt conveyor, wherein the first workpieces of the following group are held on the first belt conveyor and the last workpieces of the preceding group are held on a second belt conveyor adjoining the first and are pulled apart by the belt conveyors by at least one length of overlap of the workpieces, and to an apparatus for performing this method.

In a method of this kind suggested by FRG Offenlegungsschrift 28 15 829, the first workpieces of the following group are frictionally held on the first belt conveyor and the last workpieces of the preceding group are frictionally held on the second belt conveyor by means of pressure rollers or pressure belts moved along together therewith, so that the overlapping formation of workpieces is pulled apart by the second belt conveyor which is conveying at a higher speed or by pivoting the second belt conveyor. The method according to the prior patent application is particularly suitable for dividing groups of overlappingly superposed conveyed flat workpieces which are larger and heavier, for example sacks provided with cross-bottoms, which are to be combined in groups to form stacks or supply reels. For the purpose of sub-dividing an overlapping stream of smaller and lighter workpieces, for example flat bags of flimsy or creasable material, the proposed method is too expensive and also fails to take account of the lightweight and more sensitive material of the workpieces that are to be separated into groups.

It is therefore the problem of the present invention to provide a method and apparatus by which workpieces conveyed in overlapping superposed relationship, particularly smaller workpieces of light and sensitive material, can be separated in groups such as for the purpose of stacking same.

According to the invention, this problem is solved in a method of the aforementioned kind in that, for the purpose of deflecting the workpieces into a second conveying direction differing from the first conveying direction, the first workpiece of the group to be deflected is suction attracted by the second conveyor at its exposed leading edge while the last workpiece of the preceding group is suction attracted on the first conveyor at its trailing edge which projects beyond the second from last workpiece, and that, for the purpose of returning the overlapping flow to the first conveying direction, at least the first workpiece of the following group is suction attracted by the first conveyor at its trailing edge, that the second conveyor suction attracts only the workpieces belonging to the preceding group and the second conveyor is moved along with the first conveyor at least at the same conveying speed as same while lifted thereoff, until the last workpiece of the preceding group has been pulled out from the following group. By the method of the invention, an overlapping stream of flat workpieces can be sub-divided in a simple manner in that, after one group has passed, it is diverted from a first conveying direction to a second direction, and vice versa. Diversion of the overlapping stream out of the first conveying direction in which the workpieces are supplied into the second direction after the passage of one group is effected in a simple manner in that only the workpieces to be deflected are suction attracted by the second conveyor at their exposed leading edges so that the deflected workpieces take along the following workpieces in the second conveying direction because they are taken along by the overlapped portions of the preceding workpieces.

To return the diverted overlapping stream into the first conveying direction after the passage of one group, the last workpiece of the preceding group is held by suction on the second conveyor and the first workpiece of the following group on the first conveyor and, starting at the transfer zone, the conveyors are moved apart so that the overlapping stream can continue to move unhindered in the first conveying direction when the preceding group conveyed into the second conveying direction has had its trailing end withdrawn from the overlapping stream and lifted out of the region thereof.

The method of the invention permits the separation of groups of workpieces from an overlapping stream without the need for interrupting the continuous supply of the overlapping stream or banking it up or accelerating same. The sub-division of the overlapping stream in the manner of the invention thereby particularly takes sensitive and lightweight materials of the overlapping workpieces into account in a case where the workpieces are for example to be collected in stacks containing a particular number.

An apparatus for performing the method of the invention comprising a first suction belt conveyor supplying the overlapping flow is characterised according to the invention in that a direction-changing drum of a second suction belt conveyor is provided, which drum is in the form of a suction roller lowerable onto the first suction belt conveyor and raisable therefrom and which can be moved together with the first suction belt conveyor at least at the same speed as same and can be returned, and that the suction belts of the conveyors are provided with suction holes of which the suction air is so controllable that the conveyors can separately suction attract successive workpieces superposed on the first conveyor in overlapping formation. To deflect the overlapping stream into the second conveying direction, it is merely necessary to lower the direction-changing drum of the second suction belt conveyor onto the overlapping stream so that, together with the first workpiece suction attracted by the direction-changing drum, the entire overlapping stream is deflected into the second conveying direction of the second suction belt conveyor.

To prevent the trailing edges of the deflected workpieces lying on the first conveyor from being retained thereon under suction, the suction channels disposed under the belts of the first conveyor are desirably interrupted in the zone where the direction-changing drum is lowerable thereon.

According to one embodiment of the invention, the suction belts are provided with successive spaced suction holes which are offset from each other and associated with parallel suction channels, and the direction-changing drum is likewise provided with parallel suction channels extending over its circumference. Control of the suction air in a manner such that one conveyor suction attracts only the workpieces of the preceding group and the other conveyor suction attracts only the workpieces of the following group is problematic particularly because such control would have to take place in a time interval of milliseconds. According to the present invention, this operation can be simply effected in that the suction channel which is still being covered by the conveyor belt is connected to the source of suction air so that, at the instant when the suction holes jump from one row to the other, the first suction hole of the following row exerts suction momentarily. In an analogous manner, when the suction holes jump from one row to the other, a suction hole exerting suction can follow a suction hole which is inoperative. To bring about this change, it is merely necessary to 'sharpen' the respective passage disposed under the belts by means of a connection to the source of suction air.

Desirably, each row is provided with a particular number of suction holes, whereby one sets the minimum number of workpieces that are conveyed in the one or other conveying direction.

An efficient change from one conveying direction to the other is ensured if, in relation to the position where the direction-changing drum is applied to the first conveyor, the rows of suction holes of the first conveyor are rearwardly offset from those of the second conveyor by the length of overlap of the workpieces. By means of this displacement, one ensures that each conveyor separately suction attracts only the workpieces of the groups that are to be separated from each other so that adhesion of a workpiece to both conveyors is impossible.

Desirably, the spacing of the suction holes corresponds to the length of the non-overlapped parts of the superposed overlapping workpieces. In this way each workpiece is associated with one suction hole or, if there are a plurality of suction belts running parallel to each other, with one row of suction holes, so that each workpiece is individually located on the conveyors and its exact guiding is ensured until it is deposited on a stack.

The direction-changing drum can be mounted in a frame which receives the second conveyor belt and is hinged to a lever pivoted to the stand, drives being provided for swinging the stand about the lever and the lever relatively to the stand. By means of this arrangement, it is possible to lower the direction-changing drum onto the first conveyor precisely in the predetermined zone for the purpose of deflecting the conveyed stream and to move it together with the first conveyor for the purpose of returning the conveyed stream to the first conveying direction and to lift it off same so that, as soon as the last workpieces of the preceding group have been pulled out of the conveyed stream, the latter can pass unhindered beneath the direction-changing drum.

Further conveyors can be simply connected to the second conveyor that is mounted in the frame if the lever is hinged to the frame on the axis of a further direction-changing or driving drum and the other end of the lever is pivoted to the stand on the axis of a direction-changing drum of a third belt conveyor which takes over the separated group of the superposed overlapping workpieces from the second conveyor. The length of the lever is chosen so that the drums mounted at its ends permit transfer of the conveyed stream from the belts passing thereover.

To prevent the suction belts from slipping relatively to the direction-changing and driving drums, the suction belts may be serrated at both sides of the suction channels on the side facing the driving and direction-changing drums.

In a further embodiment of the invention, provision is made for upper belt suction conveyors which receive the separated groups of superposed overlapping workpieces and deposit the workpieces on a support in front of an abutment which can be swung away.

Desirably, these upper belts are also provided with suction holes spaced corresponding to the length of the non-overlapping parts of the workpieces, the suction channels disposed above the upper belts terminating at a spacing in front of the abutments such that the workpieces are deposited in front of the abutments with their edges straight. By means of the upper belt suction conveyors, the workpieces are guided up to their stacking station and released therefrom to be deposited with their edges aligned.

The support desirably consists of a belt conveyor which can be lowered according to the increasing stack height. To take the stacks away from the abutment, the supporting belt can be pressed against the upper belt suction conveyor and can be driven therewith in the same sense for taking the compressed stack away. This manner of discharging the stacks that are formed takes place during the interval at which the other stack is being alternately formed, so that the respective upper belt suction conveyor is stopped after disconnecting the suction air and can be driven at a lower speed with the stacking belt for the purpose of discharging the stack.

An example of the invention will now be described in more detail with reference to the drawing, wherein:

FIG. 1 is a diagrammatic side elevation of the apparatus for separating groups of workpieces supplied in superposed overlapping formation by alternate deflection into two conveying directions and for forming stacks from the groups of overlappingly superposed workpieces;

FIGS. 2 and 2*a* are diagrammatic representations of the position of the two conveyors at the instant of deflecting the overlapping stream from the first to the second conveying direction;

FIGS. 3 and 3*a* are views corresponding to FIG. 2 upon commencement of return of the conveyed stream from the second conveying direction to the first and FIGS. 4 and 4*a* are views corresponding to FIG. 3 of the position of the conveyors after separation of the overlapping stream.

From a welding cylinder 1 which is described in more detail in DE-OS No. 26 32 853, flat bags provided with lateral weld seams are transferred to the suction belt conveyor 2 which takes the bags away. The suction belt conveyor 2 is tangentially applied to the welding cylinder 1 and may in addition have its inlet and slung about part of its circumference. The finished bags 7 are supplied by the welding cylinder 1 in loops on rotatably mounted bars 3 so that the ends of the bags 7 facing the suction belt 2 are retained by a suction hole or a row of suction holes. The welding cylinder 1 runs faster than the suction belt 2 so that the leading ends of the bags are deposited on the suction belt 2 in an overlapping formation while the bars 3 are turning. The suction belt 2 passes over driving and direction-changing drums 5, 5', 5'' and under the upper run of the belts there are parallel suction channels 2', 14, 14' and 15, 15'. A direction-changing drum 17 of a second suction belt 19 can be lowered onto the suction belt 2 between the driving drum 5 and the direction-changing drum 5'. This second suction belt 19 is passed over the driving drum 21 as well as the direction-changing drums 17, 20 mounted in the frame 18. The frame 18 is mounted for pivotal motion about the axis of the driving drum 21 at the end of levers 22 of which the other ends are mounted for pivotal motion about the axis of the direction-changing drum 23 of a third suction belt that continues to convey the workpieces. The direction-changing drum 23 is mounted in the machine stand. By means of drives (not shown), the frame 18 is pivotable relatively to the levers 22 about the axis of the driving drum 21 and the levers 22 are pivotable relatively to the machine stand about the axis of the direction-changing drum 23. These drives permit the direction-changing drum 17 to be lowered from its stand-by position 17′ shown in broken lines onto the conveyor belt 2 at a zone 16 which is adjoined at both sides by the suction channels 14, 14′ and 15, 15′.

By appropriately controlling the drives, the direction-changing drum 17 can also be pivoted to the swung-out position 17″.

The diameters of the driving and direction-changing drums in the form of suction drum of the suction belts 19, 24 are so adapted to the length of the levers that the deflected group of overlappingly superposed workpieces 7 can, without relative displacement of the workpieces, be transferred by the suction belt 19 to the suction belt 24 which runs over the driving and direction-changing rollers 23, 25.

From the suction belt 24, the overlappingly superposed workpieces 7 are received by the upper belt suction conveyor 26 of which the suction belts pass over the driving and direction-changing drums 27, 28, 29. The prongs of an abutment flap 33 engage through the divided suction belts 26 and are secured on a shaft 34. The shaft 34 is provided with a drive (not shown) so that the abutment flap 33 can be swung upwardly to release the stack formed in front of same.

Beneath the abutment flap 33 there is a stacking belt 30 which runs over the driving and direction-changing drums 31, 32. The stacking belt 30 can be lowered and constructed to be applied against the belts of the upper belt suction conveyor 26.

Similarly, an upper belt suction conveyor 8 of which the belts pass over driving and direction-changing drums 9, 10 receives the separated group of overlappingly superposed workpieces 7 that has been led out by the first suction belt conveyor 2 over the direction-changing drum 17. These workpieces are deposited by the upper belt suction conveyor 8 in front of the abutment 35 on the stacking belt 11 which runs over the driving and direction-changing drums 12, 13. As soon as the supplied stack has been deposited in front of the abutment flap 35, the latter swings upwardly about the shaft 36 so that the finished stack can be discharged.

The stacking belt 11 can likewise be lowered as the height of the stack grows and be applied against the belts of the upper belt suction conveyor 8 so that the air can be pressed out of the finished stack and the latter can be discharged from the plant by simultaneous actuation of the drives of the two conveyors. The finished stacks 37*a* can then be taken from the stacking belt conveyors 11, 30 in the illustrated positions.

The sub-dividing of the continuously supplied overlapping stream into groups of overlappingly superposed workpieces that are alternatively discharged in different conveying directions will now be described in more detail with reference to FIGS. 2 to 4.

To divert the overlapping stream from the suction belt conveyor 2 to the suction belt conveyor 19 for separating the preceding group 42′ of overlappingly superposed workpieces 7, the suction channel 37′ is connected to the source of suction air while the suction channel 37 of the direction-changing drum 17 contains no suction air. The direction-changing drum 17 is now lowered out of its stand-by position 17′ onto the suction belt conveyor 2 so that it rolls on the overlapping stream until the first suction hole of the row 39 of suction holes suction attracts the workpiece 7′ out of the overlapping stream and deflects it upwardly. The following workpieces are likewise suction attracted by the row 39 of suction holes and taken away by the suction belt conveyor 19. Since the suction channels 14, 14′ and 15, 15′ of the suction belt conveyor 2 are interrupted in the zone 16, the trailing ends of the deflected workpieces no longer adhere to the suction belt conveyor 2 and can be taken along together with the suction belt conveyor 19.

To return the deflected overlapping stream and separate the deflected group of workpieces, the suction air channels 14, 15 of the suction belt 2 are connected to the source of suction air while the suction channel 37 of the direction-changing drum 17 is vented. The last suction hole of the row 41 of the suction belt conveyor 19 that runs over the suction channel 37′ which is in communication with the source of suction air holds the last workpiece 7″ of the preceding group at its non-overlapped upper edge. The first workpiece 7‴ of the following group is retained at its trailing edge by the first suction hole of the row 42 running over the channels 14, 15 of the belt 2 that are connected to the source of suction air. Since the suction channels 14, 14′ are vented, the suction holes of the row 43 of the suction belt 2 do not tend to hold the trailing ends of the upwardly deflected workpieces of the preceding group.

After the last workpieces of the preceding group have been suction attracted by the suction belt 19 and the first workpieces of the following group have been suction attracted by the suction belt 2, both in the manner as described, the direction-changing drum 17 is swung at least at the same speed as the conveying speed of the conveyor belt 2 into the position 17″ shown in FIG. 4 where the preceding group is separated from the following group.

We claim:

1. A method of separating groups of workpieces from workpieces being conveyed in a first direction in superposed overlapping formation by a first belt conveyor, wherein the first workpieces of the following group are held on the first belt conveyor and the last workpieces of the preceding group are held on a second belt conveyor adjoining the first and are pulled apart by the belt conveyors by at least one length of overlap of the workpieces, characterised in that, for the purpose of deflecting the workpieces into a second conveying direction differing from the first conveying direction, the first workpiece of the group to be deflected is suction attracted by the second belt conveyor at its exposed leading edge while the last workpiece of the preceding group is suction attracted on the first belt conveyor at its trailing edge which projects beyond the second from the last workpiece, and that, for the purpose of returning the overlapping flow to the first conveying direction, at least the first workpiece of the following group is suction attracted by the first belt conveyor at its trailing edge, that the second belt conveyor suction attracts only the workpieces belonging to the group being deflected and the second belt conveyor is moved along with the first belt conveyor at least at the same conveying speed as same while being lifted thereoff, until the last workpiece of the group being deflected has been pulled out from the following group.

2. Apparatus for separating workpieces being conveyed in a first direction in superposed formation into groups being conveyed in the first direction and groups being conveyed in a second direction comprising:

a first suction belt conveyor for supporting the superposed workpieces and for conveying groups of the workpieces in the first direction;

a second suction belt conveyor for conveying groups of the workpieces in the second direction;

a direction-changing drum supporting said second suction belt conveyor, said drum being movable towards said first suction belt conveyor so that said second suction belt conveyor contacts workpieces postioned on and being conveyed by said first suction belt conveyor and said drum being movable away from said first suction belt conveyor to thereby separate a group of workpieces from said first suction belt conveyor, the conveyor speed of said second suction belt conveyor being at least equal to the conveying speed of said first suction belt conveyor while said second suction belt conveyor is being moved away from first suction belt conveyor, said first and said second suction belt conveyors having suction holes, and means for selectively feeding suction air to said suction holes in such manner that said suction belt conveyors separately suction attract successive workpieces superposed on said first suction belt conveyor.

3. Apparatus according to claim 2, characterised in that the direction-changing drum is mounted in a frame which receives the second suction belt conveyor and is hinged to a lever pivoted to a stand, and that drives are provided for swinging the stand about the lever and the lever relatively to the stand.

4. Apparatus according to claim 2, characterised in that said means for selectively feeding suction air comprises suction channels disposed under said first suction belt conveyor, said suction channels being interrupted in a zone where the direction-changing drum is lowerable thereon.

5. Apparatus according to claim 2 or claim 4, characterised in that the suction belt conveyors are provided with successive spaced suction holes following each other in parallel rows which are offset from each other and the means for selectively feeding suction air comprises parallel suction channels associated with said parallel rows, and that the direction-changing drum is likewise provided with parallel suction channels extending over its circumference.

6. Apparatus according to claim 5, characterised in that the spacing of the suction holes corresponds to the length of the non-overlapped parts of the superposed overlapping workpieces.

7. Apparatus according to claim 5, characterised in that the lever is hinged to the frame on the axis of a further direction-changing or driving drum.

8. Apparatus according to claim 5, characterised in that the lever is pivoted to the stand on the axis of a direction-changing drum of a third belt conveyor which takes over the separated group of the superposed overlapping workpieces from the second suction belt conveyor.

9. Apparatus according to claim 8, characterised in that the third belt conveyor is also constructed as a suction belt conveyor.

10. Apparatus according to claim 5, characterised in that each row is provided with a particular number of suction holes.

11. Apparatus according to claim 5, characterised in that, in relation to the position where the direction-changing drum is applied to the first suction belt conveyor, the rows of suction holes of the first suction belt conveyor are rearwardly offset from those of the second suction belt conveyor by the length of overlap of the workpieces.

12. Apparatus according to claim 5, characterised in that the suction belt conveyors are serrated at both sides of the suction channels on the side facing driving and direction-changing drums of the conveyors.

13. Apparatus according to claim 2, characterised in that an upper belt suction conveyor is provided which receives the separated groups of superposed overlapping workpieces from the second suction belt conveyor and deposits the workpieces on a support in front of an abutment which can be swung away.

14. Apparatus according to claim 13, characterised in that the upper belt suction conveyor is provided with suction holes spaced corresponding to the length of the non-overlapping parts of the workpieces, and that suction channels disposed above the conveyor terminate at a spacing in front of the abutment such that the workpieces are deposited in front of the abutment with their edges straight.

15. Apparatus according to claim 13 or claim 14, characterised in that the support consists of a belt conveyor which can be lowered according to the increasing stack height.

16. Apparatus according to claim 15, characterised in that the support includes a supporting belt that can be pressed against the upper belt suction conveyor and can be driven therewith in the same sense for taking a compressed stack away.

* * * * *